US006591508B1

(12) United States Patent
Beckers et al.

(10) Patent No.: US 6,591,508 B1
(45) **Date of Patent: *Jul. 15, 2003**

(54) KNIFE FOR CUTTING INSULATION BATTS

(75) Inventors: William J. Beckers, 421 Munich St. Box 24, New Munich, MN (US) 56356; Richard L Studer, Avon, MN (US)

(73) Assignee: William J. Beckers, New Munich, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/405,971

(22) Filed: Sep. 27, 1999

Related U.S. Application Data

(63) Continuation of application No. 08/855,981, filed on May 14, 1997, now Pat. No. 6,122,831, which is a continuation of application No. 08/656,060, filed on May 31, 1996, now Pat. No. 5,669,142.

(51) Int. Cl.[7] ..... B26B 3/08; B26B 7/00
(52) U.S. Cl. ..... 30/314; 30/340; 30/356
(58) Field of Search ..... 30/315, 317, 125, 30/340, 517, 519, 356, 346, 314

(56) References Cited

U.S. PATENT DOCUMENTS 1,850,090 A * 3/1932 Alexander ..... 30/340 X
D235,841 S * 7/1975 Cremonese ..... D7/151

* cited by examiner

*Primary Examiner*—Douglas D. Watts
(74) *Attorney, Agent, or Firm*—Nelson R. Capes; Briggs and Morgan

(57) ABSTRACT

A knife for cutting fibrous insulation batts in a single motion with one hand consists of a blade having a smooth, curved edge adapted to both compress and cut the insulation batt along the entire length of the curved edge without tearing the insulation batt and a handle permanently and non-movably attached to one end of the blade.

20 Claims, 1 Drawing Sheet

KNIFE FOR CUTTING INSULATION BATTS

This application is a continuation of U.S. patent application Ser. No. 08/855,981, filed May 14, 1997, mow U.S. Pat. No. 6,122,831, which is a continuation of Ser. No. 08/656,060, now U.S. Pat. No. 5,669,142, issued Sep. 23, 1997.

BACKGROUND OF THE INVENTION

The present invention is directed to a knife for cutting fibrous insulation batts. Cutting this type of material is a very difficult and awkward task even for professional installers of the material. The material can be cut with a large pair of scissors but this procedure is very time consuming. The conventional utility knife is usually the cutting tool of choice by most professionals. Due to the looseness and compressibility of the material, several passes of the knife are usually required to cut the material. An elongated straight-edged tool is usually used to compress the fiber sheet of material and to guide the knife along a predetermined line of cutting. However, even this procedure is less than satisfactory. Care must be used to avoid hitting the guide edge of the compressing tool with the blade of the utility knife which increases the cutting time. Although the fibrous material is compressed along the guide edge of the compressing tool, the fibrous material extends upwardly, abruptly from the guide edge of the compressing tool, thereby making it difficult to cut the fibrous material. Also, since the operator has one hand on the compressing tool and one hand on the utility knife, he or she is unable to grasp the portion of the fibrous material which is being cut off and to prevent it from being dragged forwardly by the knife and interfering with the execution of a smooth, clean cut.

Previous devices have attempted to cure some of these difficulties by incorporating a standard utility knife in a frame which compresses the insulation batt. These devices have been less than satisfactory for a number of reasons.

First, the cost of manufacture was relatively high, because several component parts and assembly operations are required to form a complete assembly. Second, the knife housing was apt to wobble or become loose, or the knife itself may wobble or become loose within the housing. This may result in an uneven cut and may also endanger the operator's hand.

Furthermore, these devices tended to be somewhat fragile because of the presence of moving parts.

Also, these devices required the retrofit of another device: the utility knife, and were not built as one complete unit, ready to use without assembly.

In addition, the positioning of the operator's hand in previous devices did not give the operator a comfortable grip, prevented him from seeing the cut as it was being made, or exposed the operator's hand to contact with the insulation batt resulting in skin irritation.

Earlier devices which incorporated utility knives also had the utility knife's problem of tearing the insulation batt because the cutting action was concentrated at a point or along the length of a short blade.

Also, the use of utility knives requires the blade to be replaced when dull, which can be expensive and time consuming.

In such earlier devices, the compressing frame tended to contact the insulation batt over a relatively wide area causing unnecessary drag and friction and also dispersing the compressing force over an unnecessarily wide area, resulting in additional expenditure of energy to make the cut.

Furthermore, such earlier devices could not cut through multiple insulation batts at once because of the short blade of the utility knife. Often it is desirable to stack insulation batts atop one another and cut several at once, and this could not be accomplished with earlier devices.

The problems with earlier devices are amply illustrated by U.S. Pat. No. 5,075,974, which discloses a cutting tool for use on insulation batts, or other fibrous compressible materials. The tool comprises a utility knife housing having a razor-sharp cutting blade extending from one end thereof. The elongated housing is sealed in a "U"-shaped cradle that is attached to two parallel rods or wires. Flexible straps extend around the cradle and the knife housing to retain the knife housing in a fixed position on the cradle.

The parallel rods terminate in guide rings near the end of the knife housing that carries the cutting blade. The parallel rods are reversely curved to form a spring system that includes wire-like posts extending upwardly through the above-mentioned guide rings. The spring system can be positioned against a batt of insulation to exert a compressing action on the fibrous batt material when a downward manual pressure is exerted on the knife housing. During downward motion of the knife housing, the guide rings slide down on the parallel posts presumably for the purpose of ensuring a true vertical motion of the knife housing. After the insulation batt has been compressed, the knife housing can be drawn across the batt surface so that the razor blade cuts through the compressed batt thickness.

Clearly, the cost of manufacture of such a device is relatively high, because several component parts are required to form a complete assembly.

Further, the flexible straps are relatively close together such that the knife housing is apt to wobble or become loose in the cradle during operation. Also the presence of the straps makes it somewhat difficult for the workman to get his hand around the knife housing. The straps and cradle add to the side-to-side bulk dimension of the tool so that the workman cannot get a firm grip on the knife housing. This leads to the possibility that the hand may slip and contact the razor blade.

This device is also somewhat fragile because of the presence of so many moving parts.

Furthermore, the device requires the retrofit of the utility knife and is not built as one complete unit ready to use without assembly.

Furthermore, the positioning of the operator's hand gripping the utility knife prevents him from seeing the cut as it is being made. This also exposes the operator's hand to contact with the insulation batt resulting in skin irritation.

The small, sharply pointed, razor sharp utility knife of this device also has a tendency to tear the insulation batt rather than cutting it smoothly. The blade must be replaced when dull, adding to expense. The razor sharpness of the blade and its exposed location can easily lead to severe injury to the hand.

Also, the spaced-apart rods of this device contact the insulation batt over a relatively wide area causing unnecessary drag and friction and also dispersing the compressing force over an unnecessarily wide area resulting in additional expenditure of energy to make the cut.

Furthermore, this device is incapable of cutting through multiple insulation batts simultaneously since the short blade can only penetrate one batt without the knife housing interfering with the cut.

U.S. Pat. No. 5,325,594 has fewer problems than the above patent but still has the disadvantages associated with using a utility knife. Also, the wide plastic compressing member again causes unnecessary friction with the batt while dispersing the compressing force over too broad an area. Again, the position of the operator's hand prevents him from seeing the cut as it is made. Also, it is impossible to use this knife to cut multiple batts simultaneously as the knife housing and compressing member would interfere with the cut.

There is a need for an improved knife for cutting insulation batts which overcomes the problems mentioned above.

SUMMARY OF THE INVENTION

A knife for cutting fibrous insulation batts in a single motion with one hand consists of a blade having a smooth, curved edge adapted to both compress and cut the insulation batt along the entire length of the curved edge without tearing the insulation batt and a handle permanently and non-movably attached to one end of the blade.

A principal object and advantage of the present invention is that it consists of a single, integral, non-removable and non-retractable blade that both compresses and cuts the insulation batt without the need for a separate housing or compressing member.

A second principal object and advantage of the present invention is that it cuts the insulation batt along the entire length of a smooth, curved edge, which prevents the tearing of the insulation batt which is common with utility knives.

Another object and advantage of the present invention is that there are no moving parts to assemble or to break down.

Another object and advantage of the present invention is that the cost of manufacture is low.

Another object and advantage of the present invention is that there is no housing in which the blade may wobble or from which the blade may come loose, causing an uneven cut or endangering the operator's hand.

Another object and advantage of the present invention is that it provides a very comfortable grip for the operator's hand, allows the operator to see the cut as it progresses, and keeps the operator's hand away from contact with the insulation batt preventing skin irritation.

Another object and advantage of the present invention is that the knife does not need to be extremely sharp to cut the insulation and can be resharpened when dull. Thus, there is less danger of cutting the operator's hand and no need to replace the blade when it becomes too dull to cut.

Another object and advantage of the present invention is that the compressing force is directed against the insulation batt along a very narrow edge rather than along a broad compressing member. This results in less force being needed to compress the batt and less friction as the knife is drawn along the batt.

Another object and advantage of the present invention is that the width of the blade is sufficient to cut through several insulation batts, one atop the other, without interference from a blade housing.

DETAILED DESCRIPTION OF THE PREFERRED EMBODIMENTS

Figure 1:
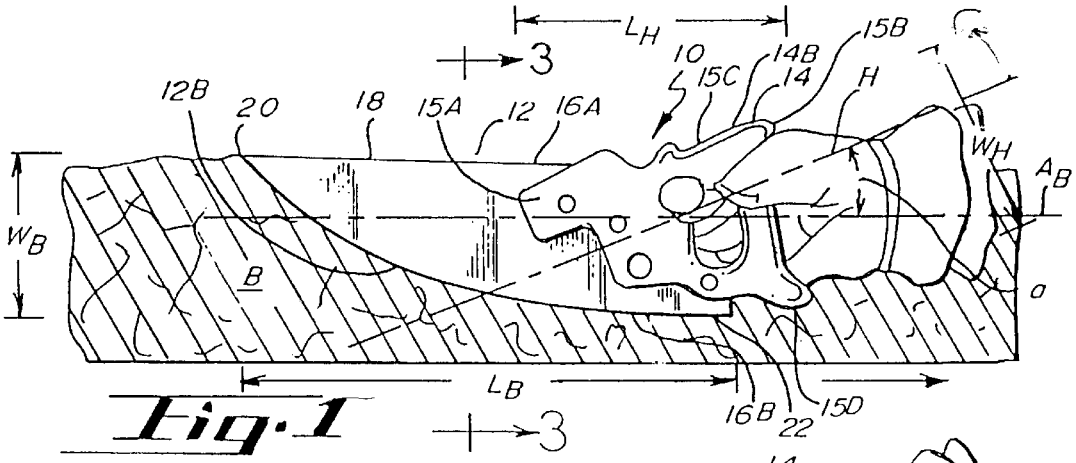
FIG. 1 is an elevational view showing the knife cutting a single insulation batt. One side of the cut batt has been removed to show the cutting action.

The insulation knife of the present invention is shown in the Figures as reference numeral 10.

The knife 10 comprises a blade 12 and a handle 14 attached to the blade. The handle 14 is preferably permanently and non-movably attached to the blade 12 at one end of the blade 12.

The blade 12 has a non-cutting back edge 16A. The blade 12 has a smooth, curved, cutting front edge 16B opposite the back edge 16A. The curved edge 16B is adapted to both compress and cut the batt B simultaneously, as can be seen in FIG. 1.

The back edge 16A and front edge 16B meet at a forward end 20. The blade 12 also has a rearward end 22 and a blade length $L_B$ between the forward end 20 and the rearward end 22. Blade width $W_B$ extends between the back edge 16A and front edge 16B.

Blade longitudinal axis $A_B$ extends between the forward end 20 and rearward end 22 intermediate the blade width, as can be seen in FIG. 1.

A handle 14 is attached to the rearward end 22 of the blade 12. The handle has a first end 15A, and a second end 15B. A handle length $L_H$, extends between the first end 15A and second end 15B. The handle also has a back side 15C and a front side 15D. A handle width $W_H$ extends between the back side 15C and front side 15D. A handle longitudinal axis $A_H$ extends between the first end 15A and second end 15B intermediate the handle width and substantially parallel to the back side 15C.

The handle 14 further comprises a blade-engaging portion 14A and a gripping portion 14B. The blade-engaging portion 14A encompasses and supports the blade 12 along a substantial portion of the blade length $L_B$. This prevents the blade 12 from flexing and wobbling during the cutting operation. The gripping portion 14B encloses the fingers of the hand H and prevents contact between the fingers and the blade and between the fingers and the batt.

The gripping portion 14B further comprises a forward blade guard 14C, a lower blade guard 14D, and a grip 14E. The grip 14E is positioned rearward of the rearward end 22 of the blade 12, as shown in the Figures, thereby preventing the hand from contacting the blade.

As can be seen in the Figures, the blade width $W_B$ increases smoothly and continuously from the forward end 20 to the rearward end 22. The blade width is greatest at the rearward end 22. At the rearward end, the blade width is preferably several inches. Most preferably, the blade width at the rearward end is in the range 4 to 6 inches.

As shown in the Figures, the handle longitudinal axis $A_H$ preferably meets the blade longitudinal axis $A_B$ at an angle a, thereby allowing the hand H to be above the insulation batt B as the blade 12 contacts the insulation batt B along a substantial portion of the blade 12. The vertex of the angle a is toward the forward end 20. Preferably, the angle a is in the range 5 degrees to 30 degrees.

As can be seen in the Figures, the front edge 16B may extend outside the blade-engaging portion 14A of the handle H. In this way, the blade 12, not the handle H, contacts the insulation.

Most preferably, the blade width adjacent the rearward end 22 is about one-fourth to about one-third of the blade length $L_B$. The handle 14 is adapted to keep the operator's hand H from touching the insulation batt B thereby avoiding skin irritation.

The blade 12 is preferably non-removable and non-retractable and can easily be resharpened by any sharpening tool such as a file or whetstone.

The operator utilizes the knife by grasping it by the handle 14 and applying downward pressure to force the curved edge 16 of the blade against the batt B. This downward pressure simultaneously compresses the batt B and cuts it in a single motion as the knife 10 is drawn in the direction of the arrow in FIG. 1. The batt will be cut along the entire length of the curved edge 16 so that there is little tendency for the batt to tear as would be the case with a short-bladed utility knife.

Because compressing and cutting pressure is exerted against the batt B along a sharp edge rather than a broad compressing member, there is little friction to overcome and the force needed to compress the batt B is less. It has been found that it is not necessary for the blade 12 to have a very sharp edge 16 in order to make the cut so the tool does not need to be kept constantly sharp and there is less danger of cutting the hand of the operator.

Because of the position of the handle 14 on the end of the blade 12, the operator's hand does not touch the batt B and the operator can see the cut as it is being made without the hand blocking his view. Also, the hand is not near the blade 12 so there is little danger of being cut.

Figure 2:
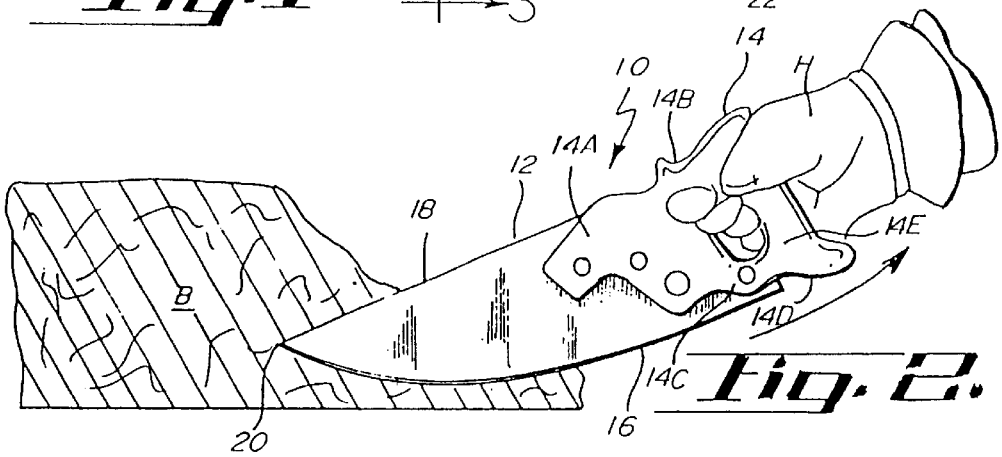
FIG. 2 is an elevational view of the knife completing the cut of an insulation batt and being rotated upwardly to complete the cut.

When the knife reaches the end of the batt B as shown in FIG. 2, the operator utilizes a natural lifting motion of the arm and hand to rotate the knife 10 as shown by the arrow so that continued cutting pressure is applied close to the forward end 20 of the knife. This allows the cut to be completed in a smooth, even motion while removing the knife 10 from the cut.

Figure 4:
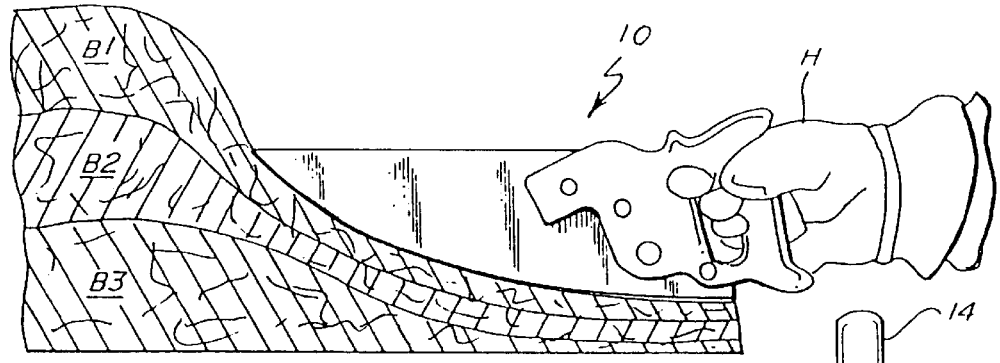
FIG. 4 is an elevational view showing the knife being used to cut multiple insulation batts simultaneously. One side of the cut batts has been removed to show the cutting action.
Figure 3:
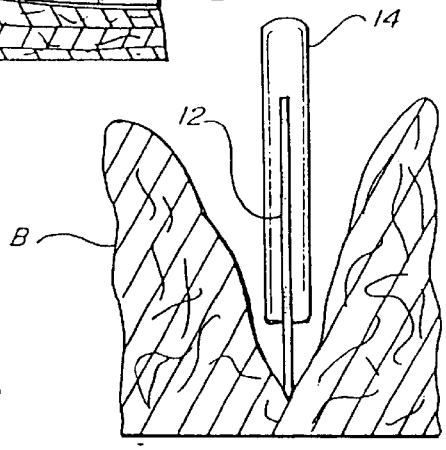
FIG. 3 is a cross-sectional view along the lines 3 of FIG. 1.

As can be seen in FIG. 4, the wide blade 12 of the knife 10 can be used to simultaneously cut several stacked batts of insulation B1, B2, B3. The batts can be simultaneously compressed and cut by the curved edge 16 and there is no blade housing to get in the way of the cut.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed:

1. A knife for cutting fibrous insulation batts in a single motion with one hand and simultaneously compressing and cutting the insulation batt, comprising:

a blade having a non-cutting back edge, a smooth, curved cutting front edge opposite the back edge adapted to compress and cut the insulation batt simultaneously, the back edge and the front edge meeting at a forward end, a rearward end, a blade length between the forward end and the rearward end, a blade width between the back edge and the front edge, and a blade longitudinal axis extending between the forward end and the rearward end intermediate the blade width; and a handle permanently and non-movably attached to the rearward end of the blade and extending rearwardly of the rearward end of the blade, the handle having a first end, a second end, a handle length between the first end and the second end, a back side, a front side, a handle width between the back side and the front side, and a handle longitudinal axis intermediate the handle width and substantially parallel to the back side, further comprising a blade-engaging portion adjacent the first end and a gripping portion adjacent the second end, the blade-engaging portion encompassing and supporting the blade along a substantial portion of the blade length, the gripping portion enclosing the fingers of the hand and preventing contact between the fingers and the blade and between the fingers and the insulation batt.

2. The knife of claim 1, wherein the blade width increases smoothly and continuously from the forward end to the rearward end, the blade width being greatest at the rearward end.

3. The knife of claim 2, wherein the blade width at the rearward end is several inches.

4. The knife of claim 3, wherein the blade width at the back end is in the range 4 to 6 inches.

5. The knife of claim 1, wherein the gripping portion further comprises a forward blade guard, a lower blade guard, and a grip, the grip being positioned rearward of the rearward end, thereby preventing the hand from contacting the blade.

6. The knife of claim 1, wherein the handle longitudinal axis meets the blade longitudinal axis at an angle, thereby allowing the hand to be above the insulation batt as the blade contacts the insulation batt along a substantial portion of the blade.

7. The knife of claim 6, wherein the vertex of the angle is toward the forward end.

8. The knife of claim 1, wherein the front edge extends outside the blade-engaging portion.

9. The knife of claim 1, wherein the blade width adjacent the rearward end is about one-fourth to about one-third of the blade length.

10. A knife for cutting fibrous insulation batts in a single motion with one hand and simultaneously compressing and cutting the insulation batt, comprising:

a blade having a non-cutting back edge, a smooth, curved cutting front edge opposite the back edge adapted to compress and cut the insulation batt simultaneously, the back edge and the front edge meeting at a forward end, a rearward end, a blade length between the forward end and the rearward end, a blade width between the back edge and the front edge, and a blade longitudinal axis extending between the forward end and the rearward end intermediate the blade width; and a handle permanently and non-movably attached to the rearward end of the blade, the handle having a first end, a second end, a handle length between the first end and the second end, a back side, a front side, a handle width between the back side and the front side, and a handle longitudinal axis intermediate the handle width and substantially parallel to the back side, further comprising a blade-engaging portion adjacent the first end and a gripping portion adjacent the second end, the blade-engaging portion encompassing and supporting the blade along a substantial portion of the blade length, the gripping portion enclosing the fingers of the hand and preventing contact between the fingers and the blade and between the fingers and the insulation batt, wherein the handle longitudinal axis meets the blade longitudinal axis at an angle, thereby allowing the hand to be above the insulation batt as the blade contacts the insulation batt along a substantial portion of the blade.

11. The knife of claim 10, wherein the blade width increases smoothly and continuously from the forward end to the rearward end, the blade width being greatest at the rearward end.

12. The knife of claim 11, wherein the blade width at the rearward end is several inches.

13. The knife of claim 12, wherein the blade width at the rearward end is in the range 4 to 6 inches.

14. The knife of claim 10, wherein the gripping portion further comprises a forward blade guard, a lower blade guard, and a grip, the grip being positioned rearward of the rearward end, thereby preventing the hand from contacting the blade.

15. The knife of claim 10, wherein the vertex of the angle is toward the forward end.

16. The knife of claim 10, wherein the front edge extends outside the blade-engaging portion.

17. The knife of claim 10, wherein the blade width adjacent the rearward end is about one-fourth to about one-third of the blade length.

18. A knife for cutting fibrous insulation batts in a single motion with one hand and simultaneously compressing and cutting the insulation batt, comprising:

a blade having a non-cutting back edge, a smooth, curved cutting front edge opposite the back edge adapted to compress and cut the insulation batt simultaneously, the back edge and the front edge meeting at a forward end, a rearward end, a blade length between the forward end and the rearward end, a blade width between the back edge and the front edge, and a blade longitudinal axis extending between the forward end and the rearward end intermediate the blade width; and a handle permanently and non-movably attached to the rearward end of the blade, the handle having a first end, a second end, a handle length between the first end and the second end, a back side, a front side, a handle width between the back side and the front side, and a handle longitudinal axis intermediate the handle width and substantially parallel to the back side, further comprising a blade-engaging portion adjacent the first end and a gripping portion adjacent the second end, the blade-engaging portion encompassing and supporting the blade along a substantial portion of the blade length, the gripping portion enclosing the fingers of the hand and preventing contact between the fingers and the blade and between the fingers and the insulation batt, wherein the gripping portion further comprises a forward blade guard, a lower blade guard, and a grip, the grip being positioned rearward of the rearward end, thereby preventing the hand from contacting the blade.

19. The knife of claim 18, wherein the handle longitudinal axis meets the blade longitudinal axis at an angle, thereby allowing the hand to be above the insulation batt as the blade contacts the insulation batt along a substantial portion of the blade.

20. The knife of claim 18, wherein the front edge extends outside the blade-engaging portion.

* * * * *